United States Patent [19]

Lipukhin et al.

[11] Patent Number: 5,009,037

[45] Date of Patent: Apr. 23, 1991

[54] APPARATUS FOR DESCALING THE SURFACE OF A STRIP

[76] Inventors: Jury V. Lipukhin, ploschad Metallurgov, 5, kv. 15; Leonid I. Danilov, ulitsa Vereschagin, 51, kv. 8; Albert N. Ivoditov, ploschad Metallurgov, 5, kv. 13; Eduard A. Garber, ulitsa M. Gorkogo, 85, kv. 17; Anatoly N. Subbotin, prospekt Pobedy, 120, kv. 14; Valentin P. Pavlov, prospekt Pobedy, 57, kv. 30, all of Vologodskaya oblast, Cherepovets; Jury K. Zhukov, Serpukhovskoi val, 13, kv. 29; Alexandr F. Pimenov, ulitsa Planernaya, 12, korpus 1, kv. 400, both of Moscow, all of U.S.S.R.

[21] Appl. No.: 294,510

[22] PCT Filed: Apr. 20, 1988

[86] PCT No.: PCT/SU88/00092

§ 371 Date: Dec. 21, 1988

§ 102(e) Date: Dec. 21, 1988

[87] PCT Pub. No.: WO88/08341

PCT Pub. Date: Nov. 3, 1988

[30] Foreign Application Priority Data

Apr. 21, 1987 [SU] U.S.S.R. ..... 4225033
Dec. 21, 1987 [SU] U.S.S.R. ..... 4340096

[51] Int. Cl.[5] ..... B24B 19/00

[52] U.S. Cl. ..... 51/7; 51/17; 51/263; 51/328; 51/DIG. 10

[58] Field of Search ..... 51/6, 7, 16, 17, 20, 51/317, 318, 417, 418, 426, DIG. 10, 436

[56] References Cited

U.S. PATENT DOCUMENTS 2,131,767 10/1938 Turnbull ..... 51/426 X

FOREIGN PATENT DOCUMENTS 2374141 8/1978 France ..... 51/426
33198 3/1977 Japan ..... 51/20
77454 5/1983 Japan ..... 51/16
86/00074 2/1988 PCT Int'l Appl. .
887048 12/1981 U.S.S.R. .
918055 4/1982 U.S.S.R. ..... 51/7
933403 6/1982 U.S.S.R. ..... 51/7
1197752 12/1985 U.S.S.R. .

*Primary Examiner*—Frederick R. Schmidt
*Assistant Examiner*—John R. Schwarzmann
*Attorney, Agent, or Firm*—Lilling and Lilling

[57] ABSTRACT

The proposed apparatus comprises a chamber containing an abrasive powder, two pairs of powder compacting mechanisms arranged one above the other, means for charging the abrasive powder to the chamber, and gates for discharging the used powder. In addition, the apparatus further includes a system of conduits for separately feeding the abrasive powder to the space between working members of the powder compacting mechanisms and the plane along which the strip is pulled, and a system of conduits for separately evacuating the powder from said working space to gates for discharging the powder from the chamber.

6 Claims, 3 Drawing Sheets

APPARATUS FOR DESCALING THE SURFACE OF A STRIP

FIELD OF THE INVENTION

This invention relates to sheet rolling, and more particularly to an apparatus for descaling the surface of a strip.

DESCRIPTION OF THE PRIOR ART

There is known an apparatus for descaling the surface of a strip by abrasive powder disclosed in SU, A No. 902,378 (International Patent Application PCT/SU No. 84/00029). This apparatus comprises a working chamber having an inclined bottom charged at the side with an abrasive powder and accommodating two oppositely arranged powder compacting mechanisms having working members in the form of vanes facing the vertical plane where-along the strip is conveyed.

This apparatus is characterized by the following. Charging the powder sideways complicates uniform filling of the space between the working members of the powder compacting mechanisms and the strip being descaled, whereby the pressure of powder on the strip can be non-uniform across the strip because of various degrees of compacting the powder, which affects the quality of strip descaling process.

The powder fills the entire space inside the working chamber rather than only the working space, whereby the powder compacting mechanisms are fully immersed in the mass of powder, and as they are moved (for bringing the working members together) a substantial part of the drive power is expended for overcoming the forces of friction between these mechanisms and the powder. This reduces the efficiency of the drive and the magnitude of the useful force which eventually leads to high power consumption and affects descaling quality due to insufficient useful force.

As continuity of the descaling process necessitates at least two pairs of alternately operating powder compacting mechanisms, this prior art apparatus envisages the use of two similar chambers arranged one above the other to complicate the apparatus in construction and servicing, and hamper the circulation of powder through the chamber.

There is also known an apparatus for descaling the surface of a strip by abrasive powder as disclosed in International Patent Application PCT/SU No. 86/00074. This apparatus, viewed by us as a prototype, comprises a working chamber to be filled with an abrasive powder accommodating two pairs of powder compacting mechanisms arranged one above the other with working members of these mechanisms facing the plane along which the strip is pulled through the chamber. Means for charging the abrasive powder are provided at the top of the working chamber, whereas valves for discharging the powder are made at the bottom part of the working chamber. These modified features of the prototype apparatus provide the following advantages versus the prior art.

Filling the working chamber with the powder and discharging the powder therefrom are facilitated due to making use of the shortest possible path, viz., in a top-to-bottom direction under the action of the forces of gravity.

Another advantage is the possibility of arranging several (at least two) alternately operating powder compacting mechanisms in one chamber thereby making the apparatus simpler in construction and cheaper in operation.

However, as in the prior art apparatus, in the prototype apparatus the powder compacting mechanisms are surrounded with the powder, whereby high amounts of power are required for turning these mechanisms (to bring the mechanisms together and descale the strip) to affect the descaling quality due to reduced useful force of compression of the powder to the strip.

Further, the bottom powder compacting mechanisms function under conditions other than those for the top mechanisms, since the powder falls from above onto the bottom powder compacting mechanisms from the space between the working members of the top powder compacting mechanisms already partially fouled with scale. This also makes descaling non-uniform in terms of the length of the strip.

In addition, the volume of powder in the space between the working members of the powder compacting mechanisms taking part in the descaling process is not over 10% of the total volume of the powder in the chamber, that is close to 90% of the powder present in the working chamber fails to participate in the descaling process. This complicates removal of scale from the powder and again affects the descaling quality. Also, the mass of abrasive powder present in the space between the non-working elements of the surface and walls of the working chamber is mostly stagnant and virtually fails to circulate.

SUMMARY OF THE INVENTION

The present invention aims at providing such an apparatus for descaling the surface of a strip in which means for feeding an abrasive powder to the chamber and evacuating it therefrom would be so constructed as to ensure circulation of the abrasive powder inside the working chamber for the powder to be independently fed to all the working descaling zones and independently evacuated from these zones, whereby all the powder fed to the chamber could take part in the strip descaling process to result in a higher quality of descaling and reduced losses of power for operation of the apparatus.

The aims of the invention are attained by an apparatus for descaling the surface of a strip comprising a chamber to be filled with an abrasive powder accommodating at least two pairs of mechanisms for compacting the powder arranged one above the other, working members of which face a plane along which the strip is conveyed to define spaces between the working members and the plane of the strip; means for charging the abrasive powder from above to the chamber; and gates for discharging the powder from the chamber provided at the bottom portion thereof. According to the invention, it includes a system of conduits for separately delivering the abrasive powder from the charging means to the space between the working members of the powder compacting mechanisms and the plane of the strip, and a system of conduits for separately evacuating the powder from this space to the gates for discharging the powder from the chamber.

Provision in the apparatus of a system of conduits for separately delivering the abrasive powder from the powder charging means to the space between each working member of the powder compacting mechanisms and the plane of conveying the strip (for the sake of bravity this space will be hereinafter referred to as the working space) makes it possible to prevent occupation of the space between the non-working elements of the powder compacting mechanisms and walls of the working chamber by the powder to result in a substantial (by a factor of 2.5–3) reduction in the losses of power for overcoming the friction between the powder compacting mechanisms and the powder, as the ratio of the area of the working members (such as vanes) to the area of the rest of the surface of the powder compacting mechanisms is normally 1:2.5–3. This allows, in the first place, a saving in power expenditures, and, in the second place, the use of the thus released energy of the drive of the powder compacting mechanisms for compacting the powder in the working space of the apparatus results in a higher strip descaling quality.

In addition, the separate feeding of the powder from the powder charging means for each powder compacting mechanism makes it possible, as distinct from the prototype, to deliver the clean powder not only to the top but also to the bottom powder discharging mechanisms, that is to attain a higher strip descaling quality during operation of the bottom powder compacting mechanisms through providing more uniform descaling conditions in terms of the length of the strip. This allows to attain a higher descaling quality.

Provision of a system of conduits for separately evacuating the powder from the working space of each powder compacting mechanism to the gates for discharging the powder from the chamber additionally improves conditions for the operation of the bottom powder compacting mechanisms and therefore the descaling quality because, as distinct from the prototype, most of the powder fouled with scale fails to be conveyed to the working members of the bottom powder descaling mechanisms, but is delivered separately along the conduits to the powder discharge gates.

Preferably, the conduit for feeding the abrasive powder to the space between the working member of the top powder compacting mechanism and the plane of the strip has the form of an inclined chute.

Such an arrangement affords to feed the clean powder from the powder charging means in a most simple and inexpensive manner, as the bottom of the inclined chute reliably quards the non-working space of the top powder compacting mechanism against occupation of this space by the powder, whereas overlying the chute is a free space not requiring additional fencing, and for this reason the use of a conduit of rectangular cross section in this case would lead to unjustified overcomplication of the apparatus and higher expenditures for its manufacture. Inclination of the chute is necessary to allow free travel of the powder therealong.

In a preferred embodiment of the apparatus the conduits for feeding the abrasive powder to the space between the working members of the bottom powder compacting mechanisms and the plane of the strip have rectangular cross section and are made up of vertical and inclined portions, whereas the conduits for evacuating the powder from the space between this plane and working members of the top powder compacting mechanisms have the form of inclined parallel tubes intersecting the conduits of rectangular cross section.

The passages for feeding the abrasive powder to the working space of the bottom powder compacting mechanisms ensure the solution of the problem of the invention in a most simple and effective manner: to communicate the working space of the bottom powder compacting mechanisms with the powder charging means thereby preventing the penetration of the powder to the space between the non-working elements of the surface of the powder compacting mechanisms and walls of the chamber. This can be accounted for by the fact that the bottom of the conduit of rectangular cross section hampers the penetration of the powder to the non-working space behind the bottom powder compacting mechanisms, whereas the wall of this conduit in opposition to the bottom prevents the penetration of the powder to the non-working space behind the top powder compacting mechanisms.

Vertical and inclined portions of this conduit ensure free travel of the powder inside the conduit under the action of the forces of gravity, which otherwise would have been impossible in the presence of horizontal portions.

Making the conduits for evacuating the powder from the working space of the top powder compacting mechanism in the form of a system of inclined parallel tubes intersecting the rectangular conduits ensures the small size of the apparatus, as the inclined portion of the passages of rectangular configuration and the system of inclined tubes are accommodated in the same space between the top and bottom powder compacting mechanisms. The tubes are inclined to a side opposite with respect to the corresponding rectangular conduits, and are arranged in parallel, whereby sufficient space is afforded in the zones of intersection therebetween for the free passage of the clean powder between the tubes. If the tubes would not be parallel, wedged portions could form therebetween hampering the free flow of powder through the rectangular conduit. Inclination of the tubes is necessary for the free movement of the powder therein evacuated from the top powder compacting mechanisms.

Advisably, the conduits for evacuating the powder from the space between the plane of the strip and working members of the powder compacting mechanisms are isolated from each other through their length, and sealingly connected to at least one gate for discharging the powder from the chamber corresponding to each conduit. This arrangement of said conduits and their connection with the powder discharging gates gives an advantage to the proposed apparatus whereby each gate discharges the powder evacuated only from one working space of one powder compacting mechanism, and therefore the same pressure of powder is ensured at each gate, whereas a difference in the pressures of powder in different conduits does not hamper the escape of the powder from those conduits where the powder pressure is lower.

Preferably, the conduits for evacuating the powder are isolated from each other by partitions secured at the bottom portion of the chamber.

Provision of partitions at the bottom portion of the chamber is the simplest way to ensure isolation of said conduits from each other.

In one preferred embodiment of the invention a flexible band fabricated from an industrial fabric is secured between the working surface of the powder compacting mechanism and conduit for feeding the abrasive powder to the space between the working member of said mechanism and the plane of the strip. Such an arrangement allows to completely separate inside the chamber the working and non-working spaces of each powder compacting mechanism, and thereby not only to prevent filling the non-working space with the abrasive powder, but also to rule out penetration of powder particles thereto, which ensures a more reliable operation of the proposed apparatus featuring the aforedescribed modifications. The band should preferably be flexible so as not to hamper the movement of the powder compacting mechanisms as they are drawn from the strip and brought closer to the strip in the course of strip descaling.

BRIEF DESCRIPTION OF THE DRAWINGS

The invention will now be described in greater detail with reference to a preferred embodiment thereof taken in conjunction with the accompanying drawings, in which.

BEST MODE OF CARRYING OUT THE INVENTION

Figure 1:
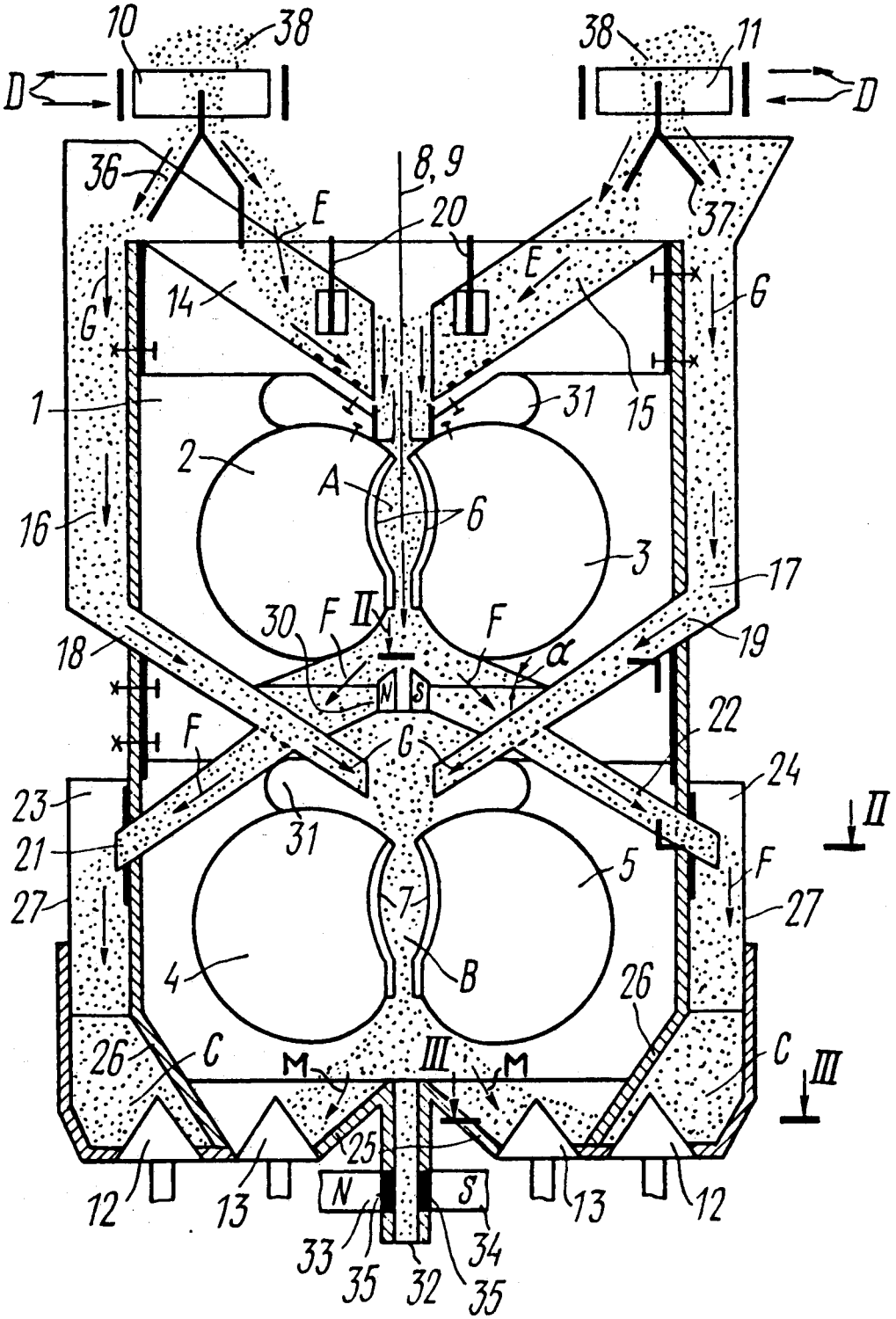
FIG. 1 is a sectional view in a vertical plane perpendicular to the plane of conveying the strip of an apparatus for descaling the surface of a strip.

An apparatus for descaling the surface of a strip comprises a chamber 1 (FIG. 1) to be filled with an abrasive powder accommodating at least two pairs of mechanisms for compacting the powder.

The proposed construction of the apparatus provides for two pairs of mechanisms 2, 3 and 4, 5 for compacting the powder, the first such pair includes mechanisms 2 and 3, whereas the second pair includes mechanisms 4 and 5. The mechanisms 2 and 3 of the first pair are disposed above the mechanisms 4 and 5 of the second pair. For ease of understanding, the mechanisms 2 and 3 for compacting the powder will hereinafter be referred to as the top mechanisms 2 and 3, while the mechanisms 4 and 5 will be referred to as the bottom mechanisms 4 and 5 for compacting the powder. Working members 6 of the top powder compacting mechanism 2 and 3, and working members 7 of the bottom powder compacting mechanisms 4 and 5 have the form of vanes facing by their concave surface toward a vertical plane 8 along which a strip 9 (in FIG. 1 positions 8 and 9 coincide) is conveyed through the chamber 1 to form a space "A" between the working members 6 of the top mechanisms 2 and 3 and the plane 8 wherealong the strip 9 is conveyed, and a space "B" between the working members 7 of the bottom mechanisms 4 and 5 and the same plane 8 of the strip 9. Electromagnets (not shown) are provided inside each mechanism 2, 3, 4, 5 for compacting the powder.

The apparatus further comprises means for charging the abrasive powder from above to the working chamber 1; each such means having the form of a conveyer 10, 11, the conveyer 10 being intended to feed the powder to the working members 6 and 7 of the mechanisms 3 and 5 for compacting the powder. The bottom part of the working chamber 1 includes gates 12 and 13 for discharging the powder from the chamber 1.

Figure 2:
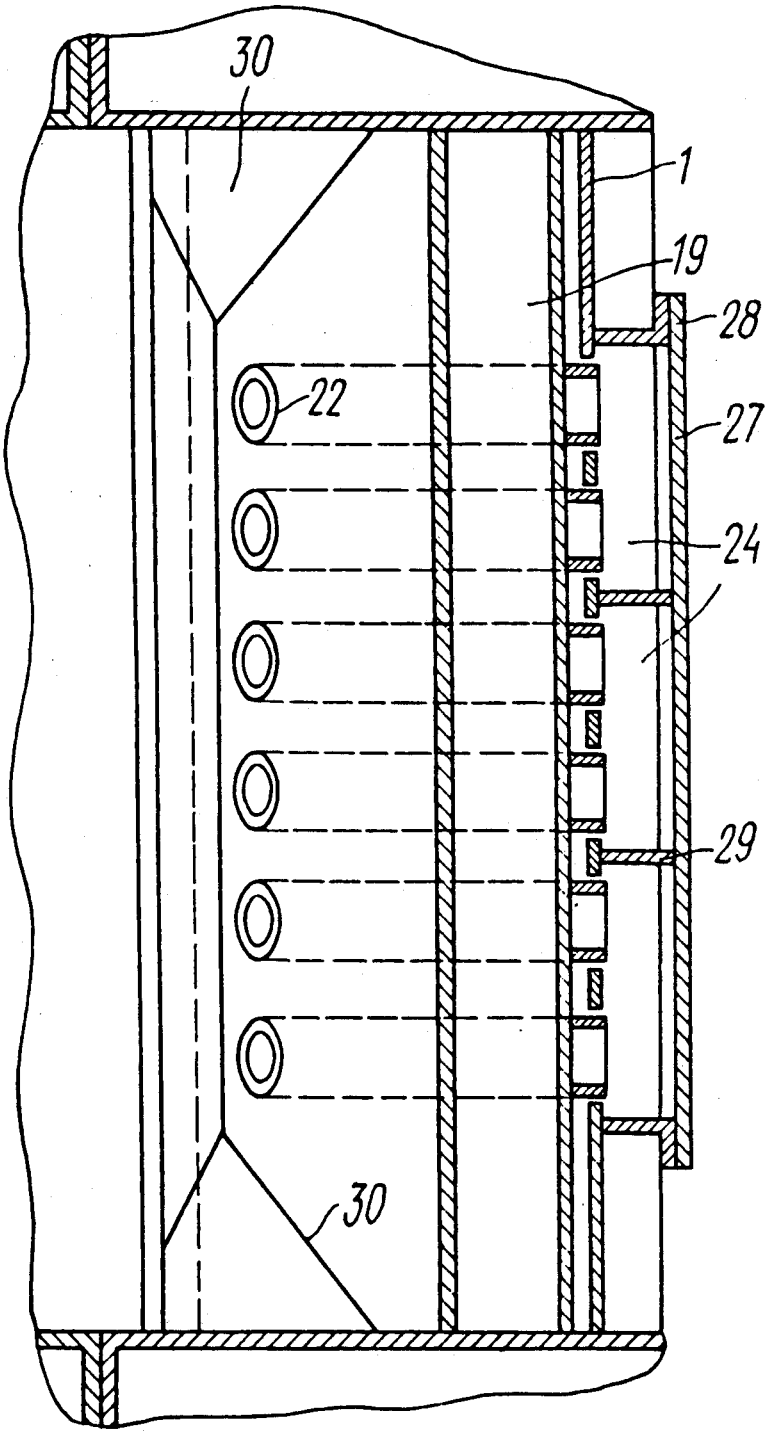
FIG. 2 is a section taken along the line II—II in FIG. 1.

One feature of the present invention resides in that the proposed apparatus has a system of conduits 14, 15, 16, 17, 18 and 19 fabricated from a nonmagnetic steel and intended for separately feeding the abrasive powder from each charging means, that is from the conveyers 10 and 11 to the spaces A and B between the working members 6 and 7 of the corresponding mechanisms 2, 3, 4 and 5 for compacting the powder and the plane 8 along which the strip 9 is pulled. The conduits 14 and 15 wherethrough the powder is delivered from the conveyers 10 and 11 to the working space A of the top powder compacting mechanisms 2 and 3 are fashioned as inclined shutes open at the top. For metering the quantity of powder conveyed to this space A the conduits 14 and 15 are provided with slide valves 20. The conduits 16, 17, 18, 19 for feeding the abrasive powder to the space B between the working member 7 of the bottom powder compacting mechanisms 4 and 5 and the plane 8 of the strip 9 have rectangular cross section of a width (FIG. 2) equal to the width of the chamber 1, the conduits 16 and 17 running vertically of the chamber 1, whereas the conduits 18 and 19 extending at an inclination to the plane 8 of the strip 9.

The apparatus also has a system of conduits 21, 22, 23 and 24 for separately withdrawing the powder from the working space A of the top powder compacting mechanisms 2 and 3 and conveying the powder to the discharging gates 12. The conduits 21, (FIG. 2) are fashioned as a system of inclined parallel tubes intersecting the conduit 18, of rectangular cross section. The conduits 22 are also fashioned as a system of inclined parallel tubes intersecting the conduit 19 of rectangular cross section. The lower ends of these tubes terminate in the vertical conduits 23 and 24 communicating with a space C immediately over the gates 12.

Figure 3:
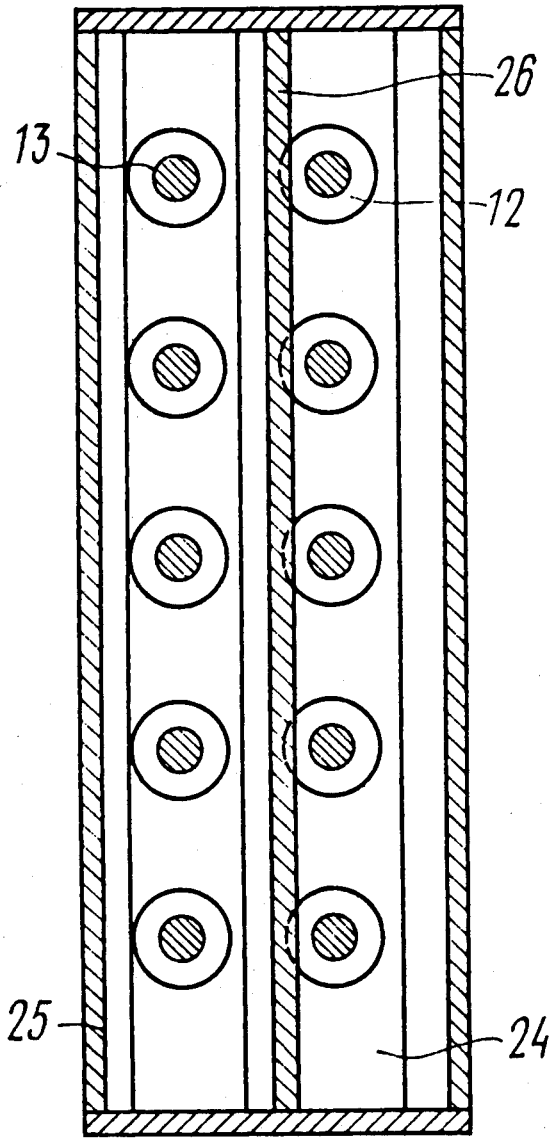
FIG. 3 is a section taken along the line III—III in FIG. 1.

The apparatus further has conduits 25 in the form of inclined chutes for separately removing the powder from the working space B of the bottom powder compacting mechanisms 4 and 5 and conveying the powder to the gates 13. Partition walls 26 separate the conduits 25 from the conduits 23, 24 thereby ensuring sealing connection of the gates 12 to the conduits 23, 24 removing the powder from the space A between the working members 6 of the top powder compacting mechanisms 2 and 3, and further isolate the conduits 23, 24 from the conduits 25 evacuating the powder from the space B between the working members 7 of the bottom powder compacting mechanisms 4 and 5. Conversely, the gates 13 are sealingly connected only with the conduits 25 conveying the powder from the working space B of the bottom powder compacting mechanisms 4 and 5, and are separated from the conduits 23 and 24 evacuating the powder from the working space A of the top mechanisms 2 and 3 (FIGS. 1 and 3).

For ease of servicing, preventive inspection and repairs of the entire system of conduits 21, 22, 23, 24, 25, 26 conveying the powder to the gates 12 and 13, the outer walls 27 (FIG. 2) of the vertical conduits 23, 24 are removable by bolted connections 28; ribs 29 being provided for rigid installation of the walls 27 in the conduits 23, 24. In order to ensure that the fouled powder fails to fall from the working space A of the top powder compacting mechanisms 2 and 3 or to penetrate into the working space B of the bottom powder compacting mechanisms 4 and 5, a slot between the top powder compacting mechanisms 2, 3 and bottom powder compacting mechanisms 4, 5 is blocked by a magnetic field produced by a magnet 30 having poles N and S thereof positioned at different sides of the plane 8.

Secured to each of the powder compacting mechanisms 2, 3, 4, 5 at its upper portion at the boundary between the working members 6, 7 and non-working (back) part of their surface by bolts are flexible bands 31 fabricated from an industrial fabric normally employed for conveyer belts. The opposite ends of the flexible bands 31 are attached at the bottom to the corresponding conduits 14, 15, 18, 19 in such a manner that the spaces A and B between the working members 6 and 7 and the strip 9 are isolated from the space between the walls of the chamber 1 and non-working (back) elements of the surfaces of the powder compacting mechanisms 2, 3, 4 and 5, whereby the powder fails to penetrate into these non-working spaces.

Provided at the bottom of the chamber 1 between the gates 13 is a port 32 (FIG. 1) intended to admit the strip 9 along the plane 8 to the chamber 1 in the upward direction. In order to prevent the escape of the abrasive powder from the chamber 1, magnetic circuits 33 (with a pole N) and 34 (with a pole S) of electromagnets (not shown) are arranged in close proximity to the walls of the port 32 at the outside. For a magnetic field induced between the poles N and S across the port 32 to have the maximum possible value of magnetic induction and thereby provide the highest force retaining the powder in the port 32, the walls of the port 32 are composite; elements of walls 35 directly adjoining the magnetic circuits 33 and 34 are made of a magnetoconductive steel, whereas the other elements are made of a nonmagnetic steel. To ensure uniform distribution of the powder between the conduits 14 and 16, 15 and 17, separating chutes 36 and 37 are provided under the conveyers 10 and 11, whereas the conveyers 10 and 11 are arranged so as to be capable of lateral displacements indicated by the arrows "D" in response to the position of the powder mass 38 across the conveyer belts.

The direction of feeding the powder 38 to the working space A of the top powder compacting mechanisms 2 and 3 is indicated by the arrows "E", and to the working space B of the bottom powder compacting mechanisms 4 and 5—by the arrows "G". The travel path of the powder 38 from the top powder compacting mechanisms 2 and 3 to the gates 12 is shown by the arrows "F", and from the bottom powder compacting mechanisms 4 and 5 to the gates 13—by the arrows "M". $\alpha$ represents the angle of repose of the loose powder mass.

The apparatus for descaling the surface of a strip operates in the following manner.

In the initial position the gates 12 and 13 are closed, the working members 6 and 7 of the powder compacting mechanisms are drawn apart, viz., removed from the plane 8, and the electromagnets are deenergized. The strip 9 to be descaled is threaded into the chamber 1 free of abrasive powder through the port 32 along the plane 8.

The front end of the strip 9 is passed through the chamber 1 and around a by-pass roller (not shown) at the top of the chamber 1, after which the strip is connected to a strip pulling mechanism (not shown). The strip is then stopped and the electromagnets of the port 32 are energized. As a result, a lateral magnetic flux is induced between the poles N and S of the magnetic circuits 33 and 34 to block the port 32 and prevent the powder from escaping therefrom. The magnetic flux acts to magnetize the elements 35 of the port 32 made of a magnetoconductive steel whereby these elements function as an elongation of the magnetic circuits 33 and 34. In consequence, the magnetic resistance in the clearance between the poles N and S is minimized, whereas the magnetic induction and, accordingly, the lateral force preventing the powder from falling out are maximized. Since the rest of the elements of the walls of the port 32 are fabricated from a nonmagnetic steel, no dissipation of the magnetic flux between the poles N and S takes place, and the magnetic induction in the clearance is not diminished.

After this the conveyers 10 and 11 are actuated to feed the abrasive powder. From a reserve hopper (not shown) the powder 38 starts to fall into the chamber 1 to be divided at each of the distribution chutes 36 and 37 into two flows: one flow travels as shown by the arrows "E" along the conduits 14 and 15 in the form of inclined chutes to the space A defined by the working members 6 of the top powder compacting mechanisms and the plane 8 wherealong the strip 9 is pulled, i.e., to the working space A of the top powder compacting mechanisms 2 and 3; the second flow runs as shown by the arrows "G" through the conduits 16, 17, 18, 19 of rectangular cross section to the working space B between the working members 7 and the plane 8 of the bottom powder compacting mechanisms 4 and 5. As the powder compacting mechanisms are drawn apart and their electromagnets are deenergized, the powder 38 freely passes through all the working zones of these mechanisms in the direction of the arrows "F" along the conduits 21 and 22 in the form of inclined tubes and then along the conduits 23, 24 to be thus conveyed from the top powder compacting mechanisms 2 and 3 to the lower part of the chamber 1 filling the space C above the gates 12. From the working space B of the bottom powder compacting mechanisms 4 and 5 the powder 38 flows to the space above the gates 13 along the conduits 25 in the form of chutes. Since all the conduits 14, 15, 16, 17, 18, 19, 21, 22, 23, 24, 25 are either vertical or inclined, the powder 38 is caused by the forces of gravity to freely move along these conduits in a top-to-bottom direction from the conveyers 10, 11 to the gates 12 and 13. The conduits 21 are parallel amongst themselves as are the conduits 22, and therefore as they intersect the rectangular conduits 18 and 19, the latter have a space sufficient for the movement of the powder 38 in the direction of the arrows "G" free of wedged portions capable of hampering the travel of the powder 38.

Thanks to such a movement, the powder occupies the spaces over the gates 12 and 13 to gradually fill the working space B of the bottom powder compacting mechanisms 4 and 5, intermediate space between the top and bottom powder compacting mechanisms 2, 3 and 4, 5, working space A of the top powder compacting mechanisms 2 and 3, and inclined conduits 14, 15.

Gradually, all the conduits 14, 15, 16, 17, 18, 19, 21, 22, 23, 24 and 25 are filled with the powder 38 to the level of the separating chutes 36 and 37.

After this the conveyers 10 and 11 are stopped, the delivery of the powder 38 to the chamber 1 is terminated, and the chamber is prepared for operation. In the spaces over the working members 6 and 7, and under the powder compacting mechanisms 2, 3 and 4, 5 the powder 38 rests at the angle $\alpha$ of repose, as in the spaces above the gates 12 and 13.

Thanks to the property of the powder 38 as that of a loose material, the nonworking spaces between the powder compacting mechanisms 2, 3, 4, 5 and walls of the chamber 1 remain free of the powder.

Then the drive of the strip tension mechanism is engaged and the strip 9 is pulled through the chamber 1 accompanied by alternately bringing the powder compacting mechanisms 2, 3 and 4, 5 together and drawing them apart at preset time intervals. When the top powder compacting mechanisms 2 and 3 are brought together, the working members 6 act to force the powder 38 to the strip 9 and remove scale from its surface. Bringing the powder compacting mechanisms together is accompanied by energization of the electromagnets, whereby the powder 38 present in the working space A between the working members 6 is magnetized, loses its capacity to flow, and fails to fall down. As the operating cycle of the mechanisms 2 and 3 comes to an end, their electromagnets are deenergized and the mechanisms are drawn apart. Simultaneously (with a certain time-advance) the bottom powder compacting mechanisms 4 and 5 are engaged to function identically to what has been described with reference to operation of the top powder compacting mechanisms 2 and 3.

Sinchronously in time with operation of the powder compacting mechanisms 2, 3 and 4, 5 and periodically over preset spaces of time, the gates 12 and 13 are opened for a few seconds to discharge the metered portions of the powder 38 from the chamber 1. Thanks to the aforedescribed, the level of the loose mass of powder 38 in the bottom part of the chamber 1 is lowered for the used powder 38 to escape from under the bottom of the mechanisms 4 and 5 (as shown by arrows M) along the conduits 25 and along conduits 23, 24 discharging the used powder as shown by the arrows F from under the top powder compacting mechanisms 2 and 3.

The pressure of powder 38 at the gates 12 is not equal to the pressure of powder 38 at the gates 13 as the length and shape of the conduits 21, 22, 23, 24 are not identical to the length and shape of the conduits 25. However, thanks to the walls 28, the mass of powder 38 present around the gates 12 is isolated from the mass of powder 38 around the gates 13, and therefore this difference in pressures fails to prevent the escape of the powder 38 from the chamber 1 through holes in the gates 12 and 13. This ensures reliable circulation of the powder through the working spaces A and B of the powder compacting mechanisms 2, 3 and 4, 5, whereby the aim of the invention, particularly high descaling efficiency, is attained.

After separating scale from the powder 38, the powder 38 is conveyed through the circulation system (not shown) along the conveyers 10 and 11 to the top of the chamber 1. In this manner continuous circulation of the powder 38 accompanied by removal of scale therefrom is effected through the chamber 1, the clean powder 38 entering the working spaces A and B of both top powder compacting mechanisms 2 and 3 and bottom powder compacting mechanisms 4 and 5.

As the powder compacting mechanisms 2 and 3, 4 and 5 are brought together, a quantity of powder 38 can be forced out of the working members 6 and 7 to move toward the nonworking spaces after these mechanisms, but such a movement is prevented by the flexible bands 31. Therefore, these nonworking spaces between the mechanisms 2, 3, 4, 5 and walls of the chamber 1 are free of the powder at any time during operation. This in turn prevents extra power losses for friction during movements executed by the powder compacting mechanisms 2, 3, 4, 5 and adds to the useful force for compressing the powder 38 to the strip 9 by the working members 6, 7. If in the course of operation it turns out that a smaller (or greater) quantity of powder is conveyed along the separating chutes 36, 37 to the top powder compacting mechanisms 2 and 3 than to the bottom powder compacting mechanisms 4 and 5, the flows of powder 38 are made more uniform by displacing the conveyers 10 and 11 according to the arrows "D" and by manipulating the slide valves 20.

Inclined positioning of the conduits 14 and 15, 18 and 19 over the powder compacting mechanisms 2 and 3, 4 and 5 makes it possible for the bottoms of these conduits to take up most of the weight of the powder and thereby relieve the mechanisms 2, 3, 4, 5 of this weight to additionally save power during their motions.

Continuous delivery of fresh powder to the top and bottom powder compacting mechanisms 2, 3, 4 and 5, and the maximum force of pressure of the powder 38 to the strip 9 thanks to the minimized losses ensure that the proposed apparatus has a higher descaling efficiency at minimized power expenditures versus the prototype.

INDUSTRIAL APPLICABILITY

The invention can be used with success for descaling the surfaces of hot-rolled wide strips of low-carbon, high-carbon, stainless, tool and other special steels.

In addition, the apparatus according to the invention can find application for removing from strip surfaces such coatings as paint, lacquer, rust, etc., and for cleaning the surface of elongated rolled stock.

What is claimed is:

1. An apparatus for descaling the surface of a strip comprising a chamber to be filled with an abrasive powder accomodating at least first and second pairs of mechanisms for compacting the powder arranged one above the other, working members of said first and second pairs of mechanisms for compacting facing a plane along which the strip is conveyed to define work spaces between the working members and the plane of the strip, means for charging the abrasive powder from above to the chamber, and first and second gates for discharging the powder from the chamber provided at the bottom portion thereof, characterized in that said apparatus for descaling includes first and second systems of conduits for separately delivering the abrasive powder from the charging means to the work spaces between the working members of the powder compacting mechanisms and said plane of the strip, and a third system of conduits for separately evacuating the powder from said work spaces to the first and second gates for discharging the powder from the chamber.

2. An apparatus as claimed in claim 1, characterized in that the conduits of the first system of conduits for feeding the abrasive powder to the work space between the working members of the top powder compacting mechanisms and said plane of the strip have the form of inclined chutes.

3. An apparatus as claimed in claim 1, characterized in that the conduits of the second system of conduits for feeding the abrasive powder to the work space between the working members of the bottom powder compacting mechanisms and said plane of the strip have a rectangular cross section, first conduits of said second system of conduits being disposed vertically and second conduits of said second system of conduits are inclined, sets of first conduits of said third system of conduits for evacuating the powder from the work space between said plane and working members of the top powder compacting mechanisms, each of said sets of first conduits having the form of a system of inclined parallel tubes intersecting the second conduits of said second system of conduits of rectangular cross section.

4. An apparatus as claimed in claim 1, characterized in that the conduits of said third system of conduits for evacuating the powder from the work space between said, plane of the strip and working members of the first and second powder compacting mechanism are isolated from each other through their length and sealingly connected to a respective gate for discharging the powder from the chamber.

5. An apparatus as claimed in claim 4, characterized in that conduits of said third system of conduits for evacuating the powder are isolated from each other by partitions secured at the bottom portion of the chamber.

6. An apparatus as claimed in claim 1, characterized in that a flexible band fabricated from an industrial fabric is secured between the working surface of the first and second powder compacting mechanisms and respective conduits of said first and second system of conduits for feeding the abrasive powder to the work space between the working members of said first and second compacting mechanisms.

* * * * *